US011817651B2

(12) United States Patent
Xu et al.

(10) Patent No.: US 11,817,651 B2
(45) **Date of Patent: *Nov. 14, 2023**

(54) CABLE CONNECTOR

(71) Applicant: BIZLINK (KUNSHAN) CO., LTD., Kunshan (CN)

(72) Inventors: Zhaojun Xu, Kunshan (CN); Jinhua Meng, Kunshan (CN)

(73) Assignee: BIZLINK (KUNSHAN) CO., LTD., Kunshan (CN)

( * ) Notice: Subject to any disclaimer, the term of this patent is extended or adjusted under 35 U.S.C. 154(b) by 111 days.

This patent is subject to a terminal disclaimer.

(21) Appl. No.: 17/489,816

(22) Filed: Sep. 30, 2021

(65) Prior Publication Data

US 2022/0021156 A1 Jan. 20, 2022

Related U.S. Application Data

(63) Continuation of application No. 16/815,026, filed on Mar. 11, 2020, now Pat. No. 11,165,199.

(30) Foreign Application Priority Data

Mar. 11, 2019 (CN) ..... 201910178604.8

(51) Int. Cl.
*H01R 12/00* (2006.01)
*H01R 13/627* (2006.01)
(Continued)

(52) U.S. Cl.
CPC ..... *H01R 13/6275* (2013.01); *H01R 13/512* (2013.01); *H01R 13/6335* (2013.01)

(58) Field of Classification Search
CPC ..... H01R 13/512; H01R 13/6275; H01R 13/6335
(Continued)

(56) References Cited

U.S. PATENT DOCUMENTS 7,422,457 B1 9/2008 Wu
8,113,723 B2 2/2012 Togami et al.
(Continued)

OTHER PUBLICATIONS

Notification Letter of Review Opinion from the Intellectual Property Bureau of the Ministry of Economic Affairs of Taiwan dated May 19, 2021 for Taiwanese Patent Application No. 109107949 filed on Mar. 11, 2020.

*Primary Examiner* — Harshad C Patel
*Assistant Examiner* — Vladimir Imas
(74) *Attorney, Agent, or Firm* — SOROKER AGMON NORDMAN PTE LTD

(57) ABSTRACT

The present disclosure relates to a connector, for docking a plugged member that is provided with a spring plate in a plug-and-pull manner, and comprises a shell, a PCBA chip partially arranged in the shell, and a locking mechanism that is connected with the shell and is used for connecting the plugged member, wherein the locking mechanism comprises an unlocking member and a guiding groove; the unlocking member comprises a guiding arm, a top wall and a pull strap, the guiding arm is slidably arranged in the guiding groove, a front end of the guiding arm forms an unlocking piece, the guiding arm is connected with the top wall, the top wall is connected with the shell through an elastic connecting member, and the pull strap is fixedly connected to a rear end of the guiding arm.

17 Claims, 5 Drawing Sheets

(51) Int. Cl.
*H01R 13/633* (2006.01)
*H01R 13/512* (2006.01)

(58) Field of Classification Search
USPC ..... 439/55
See application file for complete search history.

(56) References Cited

U.S. PATENT DOCUMENTS

| | | | | |
|---|---|---|---|---|
| 8,231,400 | B2 * | 7/2012 | Phillips | G02B 6/4201 439/357 |
| 9,118,149 | B2 * | 8/2015 | Kappla | H01R 13/665 |
| 9,219,333 | B2 * | 12/2015 | Wang | H01R 13/6275 |
| 9,548,565 | B2 * | 1/2017 | Frahmann | H01R 13/639 |

* cited by examiner

CABLE CONNECTOR

TECHNICAL FIELD OF THE INVENTION

The present disclosure relates to a pluggable connector, in particular to a connector with a locking mechanism capable of being unlocked.

BACKGROUND OF THE INVENTION

At present, a Small Form-factor Pluggable (SFP) connector is a common optical/electrical communication transceiver module. Generally, the SFP connector is provided with a locking mechanism, and when the SFP connector is docked with a socket connector, the SFP connector needs to be protruded into a storage (plugged member) first, and the locking mechanism is used to fix the SFP connector in the storage, to ensure the docking safety with the socket connector. While the connector needs to be disconnected, the SFP connector also needs to be separated from the storage by an unlocking mechanism for quick removal.

However, as the connector becomes smaller and smaller, the density of socket connectors in electronic equipments is gradually increasing, the mechanism for fixing or separating the SFP connector from the storage becomes increasingly complicated, and the operation becomes more difficult.

Therefore, it is necessary to provide a new Small Form-factor Pluggable connector for simplifying the locking and unlocking mechanisms to further simplify the unlocking operation.

SUMMARY OF THE INVENTION

A purpose of the present disclosure is to provide a connector with simple structure, fast and easy operation, and easy assembly and use.

To achieve the above purpose, the technical solution employed by the present disclosure is as follows:

A connector, is used for docking a plugged member that is provided with a spring plate in a plug-and-pull manner, which comprises a shell, a PCBA chip partially arranged in the shell, and a locking mechanism that is connected with the shell and is used for connecting the plugged member, wherein the locking mechanism comprises an unlocking member and a guiding groove that is arranged on an outer wall of the shell and extends along a plug-and-pull direction of the connector; the unlocking member comprises a guiding arm, a top wall and a pull strap, the guiding arm is slidably arranged in the guiding groove, a front end of the guiding arm forms an unlocking piece that is capable of cooperating with the spring plate, the guiding arm is connected with the top wall, the top wall is connected with the shell through an elastic connecting member capable of elastically stretching out and drawing back in the plug-and-pull direction of the connector, and the pull strap is fixedly connected to a rear end of the guiding arm.

Preferably, the shell comprises an upper shell and a lower shell that are fastened with each other, and the upper shell and the lower shell are connected through multiple sets of plug-in assemblies/fixed assemblies; one set of the plug-in assemblies comprises a convex portion provided on the upper shell and a concave portion provided on the lower shell, or one set of the plug-in assemblies comprises a concave portion provided on the upper shell and a convex portion provided on the lower shell, and the convex portion and the concave portion are fastened with each other; the fixed assemblies comprise screw holes correspondingly provided on the upper shell and the lower shell, and screws matched with the screw holes.

Preferably, the convex portion is a chamfered column with a bevel and the concave portion is a chamfered groove with a bevel, or the convex portion is a buckle with a hook and the concave portion is a block groove.

Preferably, an upper tail sleeve groove is provided at a rear end of the upper shell, and a lower tail sleeve groove is provided at a rear end of the lower shell, within the tipper tail sleeve groove is provided an upper iron ring groove, and within the lower tail sleeve groove is provided with a lower iron ring groove; when the upper shell and the lower shell are fastened with each other, the upper tail sleeve groove corresponds to the lower tail sleeve groove and the upper iron ring groove corresponds to the lower iron ring groove to form a cable groove for accommodating cable routing.

Preferably, a rear end of the lower shell is formed with a mounting surface corresponding to the top wall, the mounting surface is opened a mounting groove, the elastic connecting member is disposed in the mounting groove, and the top wall is provided with a support piece docking with the elastic connecting member within the mounting groove.

Preferably, a limiting assembly for limiting the movement range of the unlocking member is further provided between the top wall and the mounting surface, and the limiting assembly comprises a limiting boss provided on an edge of the mounting groove, and a limiting sidewall provided on the top wall and capable of cooperating with the limiting boss.

Preferably, an inner side of the lower shell is provided with a receiving groove for mounting the PCBA chip, an inner side of the upper shell is provided with an inner surface protrusion corresponding to the receiving groove, and when the upper shell and the lower shell are fastened with each other, the inner surface protrusion presses the PCBA chip into the receiving groove.

Preferably, the elastic connecting member is an unlocking spring.

Preferably, the guide groove is opened on an outer wall of the lower shell.

Preferably, two sides of the shell are correspondingly provided with a pair of the guide grooves, the unlocking piece comprises a pair of the guiding arms, the top wall is connected between the pair of the guiding arms, and the pull strap has two ends respectively connected to the pair of the guiding arms.

Due to the use of the above technical solutions, the present disclosure has the following advantages over the prior art: The present disclosure is simple in structure and low in cost, is easy and fast to unlock when in use, and is long in service life and easy to assemble.

In the above figures: 1—upper shell; 11—upper tail sleeve groove; 12—chamfered column; 13—buckle; 14—upper iron ring groove; 15—inner surface protrusion; 16—upper top surface; 17—upper body surface; 2—lower shell; 20—receiving groove; 21—lower tail sleeve groove; 22—chamfered groove; 23—block groove; 24—lower iron ring groove; 25—guiding groove; 26—lower top surface; 27—mounting surface; 28—mounting groove; 281—limiting boss; 29—unlocking spring; 3—PCBA chip; 4—unlocking member; 41—top wall; 42—guiding arm; 43—pull strap; 44—unlocking piece; 45—support piece; 46—limiting sidewall; 5—screw hole; 6—screw.

DETAILED DESCRIPTION OF EXEMPLARY EMBODIMENTS

In the following, the present disclosure is further explained in detail combining with specific embodiments shown in the accompanying drawings.

Figure 1:
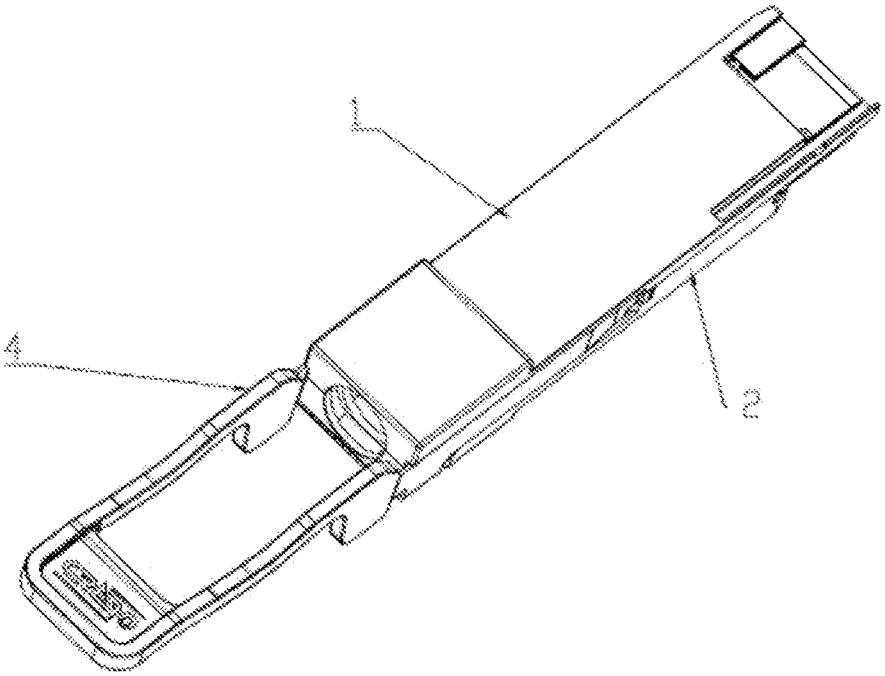
FIG. 1 is a schematic appearance diagram of a connector of the present disclosure.
Figure 2:
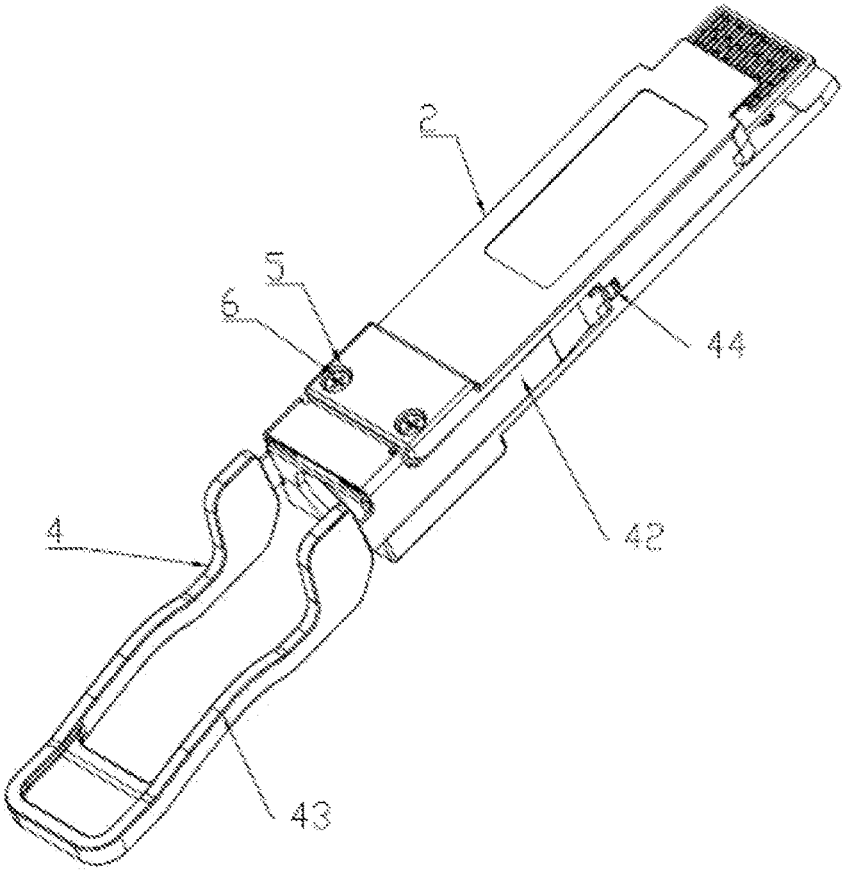
FIG. 2 is a schematic appearance diagram of the connector of the present disclosure from another perspective.
Figure 3:
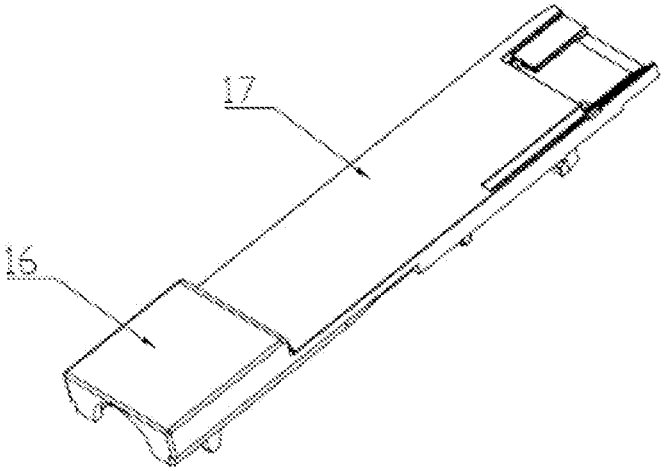
FIG. 3 is a schematic structure diagram of the upper shell of the connector of the present disclosure.
Figure 4:
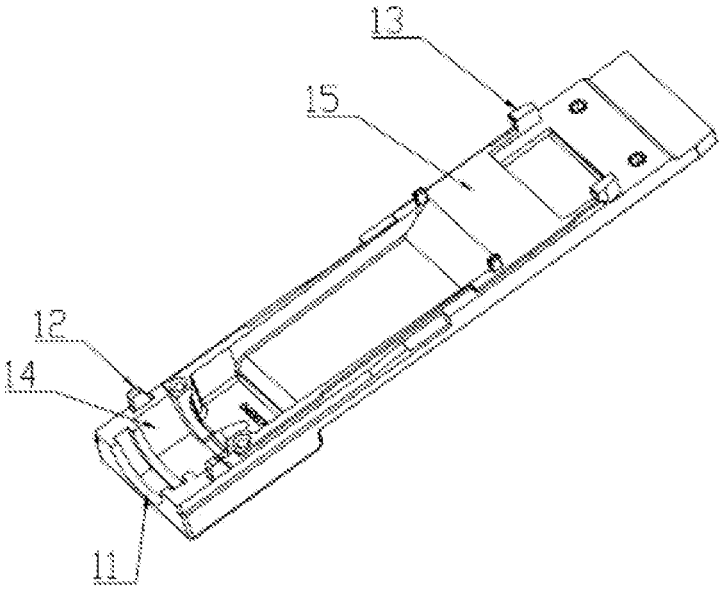
FIG. 4 is a schematic structure diagram of the upper shell of the connector of the present disclosure from another perspective.
Figure 5:
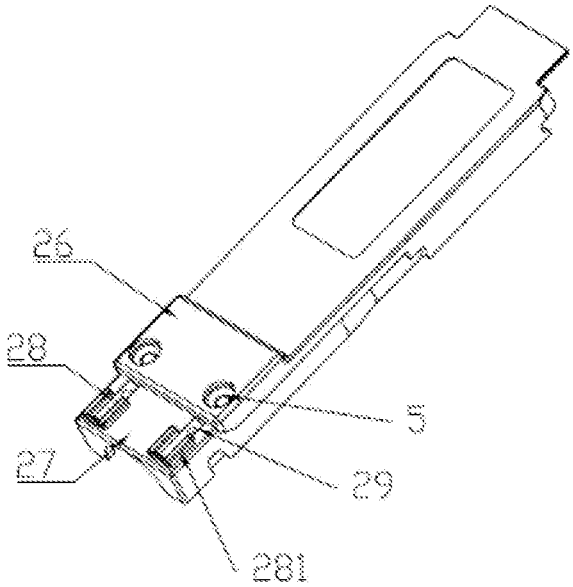
FIG. 5 is a schematic structure diagram of the lower shell of the connector of the present disclosure.
Figure 6:
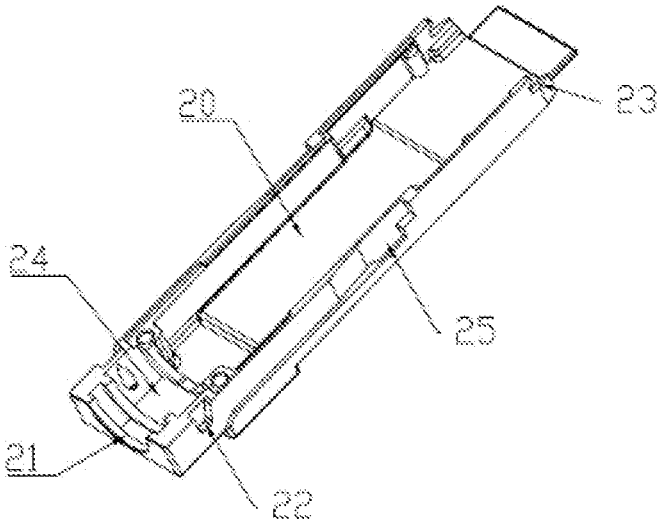
FIG. 6 is a schematic structure diagram of the lower shell of the connector of the present disclosure from another perspective.
Figure 7:
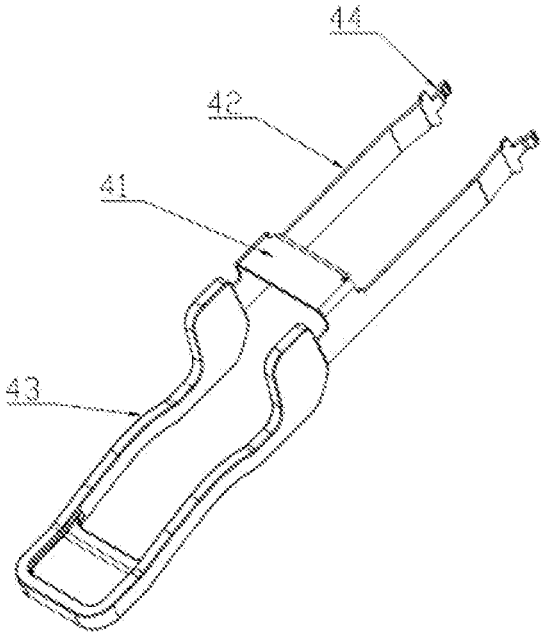
FIG. 7 is a schematic structure diagram of the unlocking member of the connector of the present disclosure.
Figure 8:
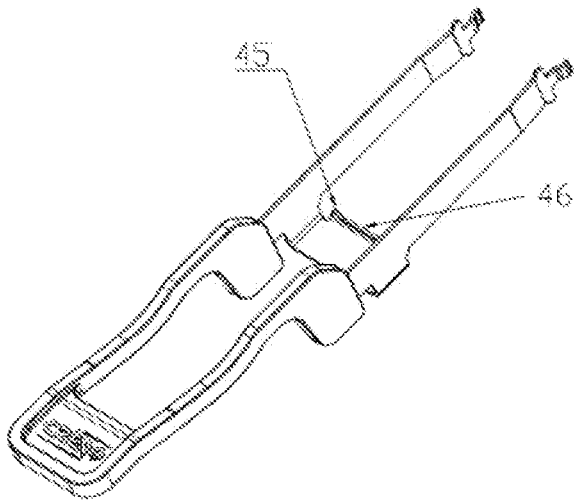
FIG. 8 is a schematic structure diagram of the unlocking member of the connector of the present disclosure from another perspective.
Figure 9:
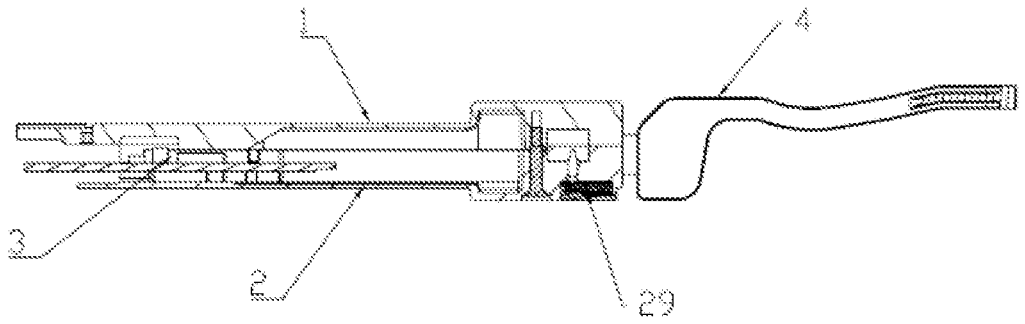
FIG. 9 is a schematic cross-sectional structure view of the connector of the present disclosure in a natural state of the unlocking spring.
Figure 10:
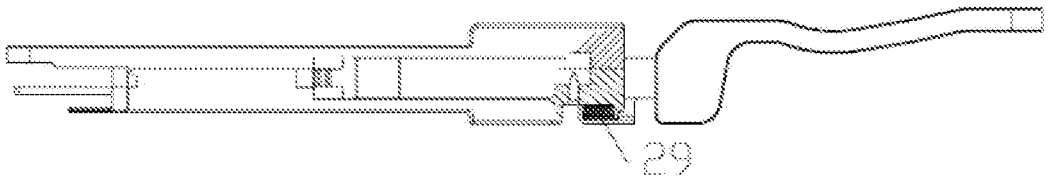
FIG. 10 is a schematic partial cross-sectional view of the connector of the present disclosure in an unlocking state.

Embodiment 1: as shown in FIG. 1 to FIG. 10, a connector for docking a plugged member (such as a storage) that is provided with a spring plate in a plug-and-pull manner, comprises a metallic shell, a PCBA chip 3 and a locking mechanism.

The shell comprises an upper shell 1 and a lower shell 2 that are fastened with each other, and the fastened shell is approximately a rectangular block, two ends defining the length direction thereof are the front end and the rear end, respectively, and the front end forms an insertion end for inserting into the plugged member, and the rear end forms a fixed end. Therefore, the following "front" refers to relatively close to the front end of the shell, that is the insertion end, and "rear" refers to relatively close to the rear end of the shell, that is the fixed end.

After the upper shell 1 is fastened, a surface thereof facing away from the lower shell 2 is an outer side thereof, the outer side of the upper shell 1 is formed with an upper body surface 17 corresponding to the insertion end thereof, and a portion close to the rear end of the upper shell 1 forms an upper top surface 16 corresponding to the fixed end thereof, and the upper top surface 16 is slightly higher than the upper body surface 17 in a vertical height direction. The upper body surface 17 is a smooth flat surface with a surface roughness of less than 0.8 micrometers, which is beneficial to heat dissipation. After the lower shell 2 is fastened, a surface thereof facing away from the upper shell 1 is an outer side thereof.

The upper shell 1 and the lower shell 2 are connected through multiple sets of plug-in assemblies/fixed assemblies. The plug-in assemblies may employ various structure forms, for example, one set of the plug-in assemblies comprises a convex portion provided on the upper shell 1 and a concave portion provided on the lower shell 2, or one set of the plug-in assemblies comprises a concave portion provided on the upper shell 1 and a convex portion provided on the lower shell 2. The convex portion and the concave portion are fastened with each other. In the present embodiment, a convex portion provided on the upper shell 1 and a concave portion provided on the lower shell 2 are adopted. The convex portion is a chamfered column 12 with a bevel and the concave portion is a chamfered groove 22 with a bevel, or the convex portion is a buckle 13 with a hook and the concave portion is a block groove 23. In the present embodiment, a total of four sets of plug-in assemblies are provided, of which two sets of opposite plug-in assemblies located at the rear end of the shell use chamfered columns 12 and chamfered grooves 22, and two sets of opposite plug-in assemblies located at the front end of the shell use buckles 13 and block grooves 23. The plug-in assemblies are provided at lateral borders where the upper shell 1 and the lower shell 2 dock with each other. When the upper shell 1 and the lower shell 2 are fastened with each other, the chamfered columns 12 are inserted into the chamfered grooves 22, and the buckles 13 are inserted into the block grooves 23. The fixed assemblies comprise screw holes 5 correspondingly provided on the upper shell 1 and the lower shell 2, and screws 6 matched with the screw holes 5. The addition of the fixed assemblies on the basis of the plug-in assemblies can better implement the connection between the upper shell 1 and the lower shell 2. In the present embodiment, a middle and rear portion of the lower shell 2 is provided with a lower top surface 26, and the screw holes 5 are opened at the lower top 26, and the screws 6 are also mounted at the lower top surface 26.

After the upper shell 1 is fastened, a surface thereof close to the lower shell 2 is an inner side thereof, and after the lower shell 2 is fastened, a surface thereof close to the upper shell 1 is an inner side thereof. The inner side of the rear end of the upper shell 1 is opened with an arc upper tail sleeve groove 11, the inner side of the rear end of the lower shell 2 is opened with a lower tail sleeve groove 21, within the upper tail sleeve groove 11 is provided an upper iron ring groove 14, and within the lower tail sleeve groove 21 is provided with a lower iron ring groove 24. When the upper shell 1 and the lower shell 2 are fastened with each other, the upper tail sleeve groove 11 corresponds to the lower tail sleeve groove 21 and the upper iron ring groove 14 corresponds to the lower iron ring groove 24 to form a cable groove for accommodating cable routing.

The inner side of the lower shell 2 is opened with a receiving groove 20 for mounting the PCBA chip 3, the inner side of the upper shell 1 is provided with an inner surface protrusion 15 corresponding to the receiving groove 20. At least a part of the PCBA chip 3 is provided within the shell. When the upper shell 1 and the lower shell 2 are fastened with each other, the inner surface protrusion 15 presses the PCBA chip 3 into the receiving groove 20, the inner surface protrusion 15 of the upper shell 1 squeezes the thermal conductive mud on the upper surface of the PCBA chip 3 to introduce the heat of the PCBA chip 3 to the outer side of the upper shell 1 for emission. Wherein, the thickness of the inner surface protrusion 15 is generally 3.5-3.7 mm, and a distance between the inner surface protrusion 15 and the PCBA chip 3 is 0.24-0.26 mm. A front portion of the PCBA chip 3 protrudes outside the front end of the shell, and the cable connected with the PCBA chip 3 pass through the cable groove and leads to the outside of the rear end of the shell.

The locking mechanism is connected with the shell and is used for connecting the plugged member. The locking mechanism comprises an unlocking member 4 and a guiding groove 25 that is arranged on an outer wall of the shell and extends along a plug-and-pull direction of the connector. In the present embodiment, the guiding groove 25 is opened on an outer wall of the lower shell 2. The unlocking member 4 comprises a guiding arm 42, a top wall 41 and a pull strap 43. The guiding arm 42 is slidably arranged in the guiding groove 25, a front end of the guiding arm 42 forms an unlocking piece 44 that is capable of cooperating with the spring plate. The guiding arm 42 is connected with the top wall 41, the top wall 41 is connected with the shell through an elastic connecting member capable of elastically stretching out and drawing back in the plug-and-pull direction of the connector, and the pull strap 43 is fixedly connected to a rear end of the guiding arm 42. Specifically, two sides of the shell are correspondingly provided with a pair of the guiding grooves 25, then the unlocking piece 44 comprises a pair of the guiding arms 42 symmetrically provided, the top wall 41 is connected between the pair of the guiding arms 42 so that the top wall 41 is substantially vertical to the guiding arms 42, and the pull strap 43 has two ends respectively connected to the pair of the guiding anus 42. A rear end of the lower shell 2 is formed with a mounting surface 27 corresponding to the top wall 41, and the mounting surface 27 is located behind the lower top surface 26 and is under the lower top surface 26 in a direction vertical to its height direction. The mounting surface 27 is opened with a pair of mounting grooves 28, and a pair of elastic connecting members is correspondingly disposed in the mounting grooves 28. The elastic connecting members adopt unlocking springs 29. The top wall 41 is provided with support pieces 45 docking with the elastic connecting members within the mounting grooves 28. Therefore, a front edge of the mounting surface 27 is vertically bend downward to form a pair of support pieces 45, and inserted into the corresponding unlocking springs 29. A limiting assembly for limiting the movement range of the unlocking member 4 is further provided between the top wall 41 and the mounting surface 27, and the limiting assembly comprises limiting bosses 281 provided on edges of the mounting grooves 28, and limiting sidewalls 46 provided on the top wall 41 and capable of cooperating with the limiting bosses 281. A front edge of the top wall 41 between the pair of support pieces 45 is vertically bend downward to form the limiting sidewalls 46.

When assembling the above connector, the PCBA chip 3 is first mounted in the receiving groove 20 of the lower shell 2, and then covered with the upper shell 1, so that the upper shell 1 and the lower shell 2 are positioned through the cooperation between the chamfered columns 12 and the chamfered grooves 22 and between the buckles 13 and the block grooves 23, then the unlocking springs 29 are mounted within the mounting grooves 28 of the lower shell 2, following by assembling the unlocking member 4 to the lower shell 2, so that the top wall 41 of the unlocking member 4 is mounted on the mounting surface 27 of the lower shell 2, the support pieces 45 of the unlocking member 4 is stuck in the unlocking springs 29 of the lower shell 2, and at the same time, the movements of the two guiding arms 42 of the unlocking member 4 are respectively limited within the two guiding grooves 25 on the two sides of the lower shell 2. Finally, the fastened upper shell 1 and lower shell 2 are locked tightly through the screws 6.

When in use, the connector is inserted into the plugged member, such as a storage, the unlocking pieces 44 on the two guiding arms 42 of the unlocking member 4 are fastened with the corresponding spring plates within the storage to lock tightly. When requiring to pull out the connector, the pull strap 43 of the unlocking member 4 is pulled rearward, the pull strap 43 brings the top wall 41 and the support pieces 45 thereof to move rearward, the support pieces 45 compress the unlocking springs 29 of the lower shell 2 due to being stuck in the unlocking springs 29, and bring the two guiding arms 42 and the unlocking pieces 44 thereon to push out the spring plates within the storage, and thus the unlocking is achieved, and the connector can be pull out successfully. In the unlocking process, the limiting bosses 281 on the mounting surface 27 of the lower shell 2 cooperate the limiting sidewalls 46 on the top wall 41 of the unlocking member 4 to limit the maximum position where the unlocking member 4 can be pull rearward. After the connector is pulled out, the pull strap 43 is released, and the unlocking springs 29 bring the two guiding anus 42 to restore through the support pieces 45.

It can be seen that in the present disclosure, a spring mechanism is first reset and then unlocked and restored, which is not only simple in structure and low in cost, but also easy and fast to unlock, and better in feel, and at the same time, the springs have a long service life and rebound smoothly; secondly, by adding the structure of the chamfered columns 12 and the chamfered grooves 22 between the upper shell 1 and the lower shell 2, it is easier to assemble in place: besides, providing the inner surface bosses inside the upper shell 1, can better transfer the heat generated by the PCBA chip 3 to the surface of the iron shell, which is easy to dissipate heat; in addition, the smooth and flat surface of the upper shell 1 makes the contact between the connector and the storage better, and the heat dissipation faster.

The embodiments described above are only for illustrating the technical concepts and features of the present disclosure, and are intended to make those skilled in the art being able to understand the present disclosure and thereby implement it, and should not be concluded to limit the protective scope of this disclosure. Any equivalent variations or modifications according to the spirit of the present disclosure should be covered by the protective scope of the present disclosure.

The invention claimed is:

1. A cable connector, comprising a shell, a PCBA chip at least partially arranged in the shell, and a locking mechanism that is connected with the shell, wherein the locking mechanism comprises an unlocking member and a guiding groove that is arranged on an outer wall of the shell and extends along a plug-and-pull direction of the connector; the unlocking member comprises a guiding arm, a top wall and a pull strap, the guiding arm is slidably arranged in the guiding groove, a front end of the guiding arm forms an unlocking piece, the guiding arm is connected with the top wall, the top wall is connected with the shell through an elastic connecting member capable of elastically stretching out and drawing back in the plug-and-pull direction of the connector, and the pull strap is fixedly connected to a rear end of the guiding arm, wherein the shell comprises an upper shell and a lower shell that are fastened with each other, and the upper shell and the lower shell are connected through multiple sets of plug-in assemblies or fixed assemblies, one set of the plug-in assemblies comprises a convex portion provided on the upper shell and a concave portion provided on the lower shell, or one set of the plug-in assemblies comprises a concave portion provided on the upper shell and a convex portion provided on the lower shell, and the convex portion and the concave portion are fastened with each other; the fixed assemblies comprise screw holes correspondingly provided on the upper shell and the lower shell, and screws matched with the screw holes;

wherein a rear end of the lower shell is formed with a mounting surface corresponding to the top wall, the mounting surface is opened a mounting groove, the elastic connecting member is disposed in the mounting groove, and the top wall is provided with a support piece docking with the elastic connecting member within the mounting groove.

2. The cable connector according to claim 1, wherein the convex portion is a chamfered column with a bevel and the concave portion is a chamfered groove with a bevel, or the convex portion is a buckle with a hook and the concave portion is a block groove.

3. The cable connector according to claim 1, wherein a limiting assembly for limiting the movement range of the unlocking member is further provided between the top wall and the mounting surface, and the limiting assembly comprises a limiting boss provided on an edge of the mounting groove, and a limiting sidewall provided on the top wall and capable of cooperating with the limiting boss.

4. The cable connector according to claim 1, wherein an inner side of the lower shell is provided with a receiving groove for mounting the PCBA chip, an inner side of the upper shell is provided with an inner surface protrusion corresponding to the receiving groove, and when the upper shell and the lower shell are fastened with each other, the inner surface protrusion presses the PCBA chip into the receiving groove.

5. The cable connector according to claim 1, wherein the elastic connecting member is a spring.

6. The cable connector according to claim 5, wherein an upper tail sleeve groove is provided at a rear end of the upper shell, and a lower tail sleeve groove is provided at a rear end of the lower shell, within the upper tail sleeve groove is provided an upper ring groove, and within the lower tail sleeve groove is provided with a lower ring groove; when the upper shell and the lower shell are fastened with each other, the upper tail sleeve groove corresponds to the lower tail sleeve groove and the upper ring groove corresponds to the lower ring groove to form a cable groove for accommodating cable routing.

7. The cable connector according to claim 1, wherein the guiding groove is opened on an outer wall of the lower shell.

8. The cable connector according to claim 1, wherein two sides of the shell are correspondingly provided with a pair of the guiding grooves, the unlocking piece comprises a pair of the guiding arms, the top wall is connected between the pair of the guiding arms, and the pull strap has two ends respectively connected to the pair of the guiding arms.

9. A cable connector, comprising:

a shell, having an outer wall, the outer wall having a guiding groove formed thereon, the guiding groove extending along a plug-and-pull direction, the shell comprising an upper shell and a lower shell, the upper shell and the lower shell are fastened with each other by either multiple sets of plug-in assemblies or multiple sets of fixed assemblies;

a PCBA chip, at least part of the PCBA chip located in the shell; and an unlocking member, at least part of the unlocking member being slidably disposed in the guiding groove, the unlocking member comprising a top wall, a guiding arm and a handle, the top wall having a support piece, the guiding arm being connected with the top wall, a front end of the guiding arm having an unlocking piece, and the handle being connected to a rear end of the guiding arm;

wherein, a rear end of the lower shell has a mounting surface corresponding to the top wall, the mounting surface has a mounting groove formed thereon, the elastic connecting member is disposed in the mounting groove, and the support piece of the top wall is connected with the elastic connecting member within the mounting groove so as to be moveably connected with the shell.

10. The cable connector according to claim 9, wherein one set of the plug-in assemblies comprises a convex portion provided on the upper shell and a concave portion provided on the lower shell, or one set of the plug-in assemblies comprises a concave portion provided on the upper shell and a convex portion provided on the lower shell, and the convex portion and the concave portion are fastened with each other; the fixed assemblies comprise screw holes correspondingly provided on the upper shell and the lower shell, and screws matched with the screw holes.

11. The cable connector according to claim 10, wherein the convex portion is a chamfered column with a bevel and the concave portion is a chamfered groove with a bevel, or the convex portion is a buckle with a hook and the concave portion is a block groove.

12. The connector according to claim 11, wherein an upper tail sleeve groove is provided at a rear end of the upper shell, and a lower tail sleeve groove is provided at a rear end of the lower shell, within the upper tail sleeve groove is provided an upper ring groove, and within the lower tail sleeve groove is provided with a lower ring groove; when the upper shell and the lower shell are fastened with each other, the upper tail sleeve groove corresponds to the lower tail sleeve groove and the upper ring groove corresponds to the lower ring groove to form a cable groove for accommodating cable routing.

13. The cable connector according to claim 9, wherein a limiting assembly for limiting the movement range of the unlocking member is further provided between the top wall and the mounting surface, and the limiting assembly comprises a limiting boss provided on an edge of the mounting groove, and a limiting sidewall provided on the top wall and capable of cooperating with the limiting boss.

14. The cable connector according to claim 9, wherein an inner side of the lower shell is provided with a receiving groove for mounting the PCBA chip, an inner side of the upper shell is provided with an inner surface protrusion corresponding to the receiving groove, and when the upper shell and the lower shell are fastened with each other, the inner surface protrusion is pressed to the PCBA chip and located in the receiving groove.

15. The cable connector according to claim 9, wherein the elastic connecting member is a spring.

16. The cable connector according to claim 15, wherein two sides of the shell are correspondingly provided with a pair of the guiding grooves, the unlocking piece comprises a pair of the guiding arms, the top wall is connected between the pair of the guiding arms, and the handle has two ends respectively connected to the pair of the guiding arms.

17. The cable connector according to claim 16, wherein the support piece is formed at an edge of the top wall, the support piece being one piece formed with the top wall.

* * * * *